US009786099B2

(12) United States Patent
Matsuno et al.

(10) Patent No.: US 9,786,099 B2
(45) Date of Patent: Oct. 10, 2017

(54) COINAGE IDENTIFICATION DEVICE

(71) Applicant: LECIP HOLDINGS CORPORATION, Motosu-shi, Gifu-ken (JP)

(72) Inventors: Takeshi Matsuno, Motosu (JP); Yasuhiro Suzuki, Motosu (JP)

(73) Assignee: LECIP HOLDINGS CORPORATION, Gifu-Ken (JP)

( * ) Notice: Subject to any disclaimer, the term of this patent is extended or adjusted under 35 U.S.C. 154(b) by 0 days.

(21) Appl. No.: 15/037,454

(22) PCT Filed: Nov. 20, 2014

(86) PCT No.: PCT/JP2014/080829
§ 371 (c)(1),
(2) Date: May 18, 2016

(87) PCT Pub. No.: WO2015/076350
PCT Pub. Date: May 28, 2015

(65) Prior Publication Data

US 2016/0300399 A1 Oct. 13, 2016

(30) Foreign Application Priority Data

Nov. 22, 2013 (JP) ..... 2013-242148

(51) Int. Cl.
*G07B 15/00* (2011.01)
*G07D 9/00* (2006.01)
(Continued)

(52) U.S. Cl.
CPC ..... *G07B 15/00* (2013.01); *G07D 9/00* (2013.01); *G07D 9/008* (2013.01); *G07F 1/02* (2013.01); *G07F 9/04* (2013.01)

(58) Field of Classification Search
CPC ..... G07B 15/00; G07B 15/066; G07F 1/02; G07F 1/046; G07F 1/04; G07F 9/04; G07D 9/008; G07D 9/00
(Continued)

(56) References Cited

U.S. PATENT DOCUMENTS 4,977,502 A * 12/1990 Baker ..... G07B 15/00 232/7
5,059,153 A * 10/1991 Goi ..... G07D 3/02 453/11
(Continued)

FOREIGN PATENT DOCUMENTS

JP 59104272 U 7/1984
JP 2002060047 A 2/2002
(Continued)

OTHER PUBLICATIONS

International Preliminary Search Report on Patentability; International Application No. PCT/JP2014/080829; International Filing Date Nov. 20, 2014; dated Feb. 24, 2016, 4 pages.

*Primary Examiner* — William Miller
(74) *Attorney, Agent, or Firm* — Cantor Colburn LLP

(57) ABSTRACT

Provided is a coinage identification device (6), comprising: a coinage sorting device (6A), which is configured to further comprise a first coinage guidance unit (9), and a second coinage guidance unit (10) which moves between a narrowing location which is close to the first coinage guidance unit (9) and a widening location which is separated from the first coinage guidance unit (9), and to cause a plurality of coins to fall in batches of a defined number from between the first coinage guidance unit (9) and the second coinage guidance unit (10); and a coinage intake (28*a*) which is disposed below the first coinage guidance unit (9) and the second coinage guidance unit (10), and which accepts the coins which fall from between the first coinage guidance unit (9)
(Continued)

and the second coinage guidance unit (10). When a coin is jammed between the first coinage guidance unit (9) and the second coinage guidance unit (10), the coinage sorting device (6A) moves the second coinage guidance unit (10) from the narrowing location to the widening location, thereby widening the space between the first coinage guidance unit (9) and the second coinage guidance unit (10) and causing the jammed coin to fall. The coinage identification device further comprises a shutter unit (31) which covers the coinage intake (28*a*) when the second coinage guidance unit (10) is positioned in the widening location.

9 Claims, 9 Drawing Sheets

(51) Int. Cl.
*G07F 1/02* (2006.01)
*G07F 9/04* (2006.01)

(58) Field of Classification Search
USPC ..... 232/7, 9, 44, 15, 16, 1 D; 194/200, 344, 194/351; 453/11
See application file for complete search history.

(56) References Cited

U.S. PATENT DOCUMENTS

| | | | | |
|---|---|---|---|---|
| 6,039,164 | A * | 3/2000 | Waters | G07F 9/06 194/206 |
| 8,210,336 | B2 * | 7/2012 | Nishida | G07D 9/008 194/302 |
| 8,465,349 | B2 * | 6/2013 | Nishida | G07D 1/00 453/57 |
| 8,615,123 | B2 * | 12/2013 | Dabic | G07D 3/14 194/317 |
| 8,668,134 | B2 * | 3/2014 | Kimoto | G07D 11/0018 109/66 |
| 8,839,938 | B2 * | 9/2014 | Shimizu | G07D 3/16 194/344 |
| 2010/0041325 | A1 * | 2/2010 | Takeuchi | G07D 1/02 453/3 |

FOREIGN PATENT DOCUMENTS

| | | |
|---|---|---|
| JP | 2008083976 A | 4/2008 |
| JP | 2012164299 A | 8/2012 |

* cited by examiner

COINAGE IDENTIFICATION DEVICE

TECHNICAL FIELD

The present invention relates to a coin recognition machine that recognizes the types of received coins.

BACKGROUND ART

A coin recognition machine arranged in, for example, a farebox, is known in the art (refer to Patent Document 1). The coin recognition machine of Patent Document 1 rotates two opposing rollers so that a specified number of received coins fall out of a gap between the two rollers. The coin recognition machine uses a coin recognition unit, which is located in the coin recognition machine, to recognize the types of the specified number of falling coins. The two rollers include a fixed roller and a movable roller. When coins are jammed between the fixed roller and the movable roller, the movable roller moves relative to the fixed roller to widen the gap between the fixed roller and the movable roller and drops the coins jammed between the fixed roller and the movable roller.

PRIOR ART DOCUMENT

Patent Document

Patent Document 1: Japanese Laid-Open Patent Publication No. 2012-164299

SUMMARY OF THE INVENTION

Problems that are to be Solved by the Invention

When dropping a number of coins jammed between the fixed roller and the movable roller, the coins simultaneously enter a coin inlet of the coin recognition unit and jam the coin inlet.

It is an object of the present invention to provide a coin recognition machine that reduces coin jamming in a coin inlet of a coin recognition unit.

Means for Solving the Problem

One aspect of the present invention is a coin recognition machine that includes a coin aligner including a first coin guide and a second coin guide, which moves between a narrow position that is close to the first coin guide and a wide position that is separated from the first coin guide. The coin aligner is configured such that a specified number of coins fall from between the first coin guide and the second coin guide. The coin recognition machine also includes a coin inlet that receives a coin falling from between the first coin guide and the second coin guide. The coin inlet is located below the first coin guide and the second coin guide. When a coin is jammed between the first coin guide and the second coin guide, the coin aligner moves the second coin guide from the narrow position to the wide position to widen a gap between the first coin guide and the second coin guide so that the jammed coin falls. The coin recognition machine further includes a shutter that covers the coin inlet when the second coin guide is located at the wide position.

EFFECT OF THE INVENTION

The present invention reduces coin jamming in a coin inlet of a coin recognition unit.

BRIEF DESCRIPTION OF THE DRAWINGS

FIG. 3 shows the internal structure of a coin recognition machine, in which

FIG. 6 is a perspective view showing the shutter and components around the shutter as viewed from a rear surface, in which

EMBODIMENTS OF THE INVENTION

One embodiment of a coin recognition machine will now be described with reference to FIGS. 1 to 14.

Figure 1:
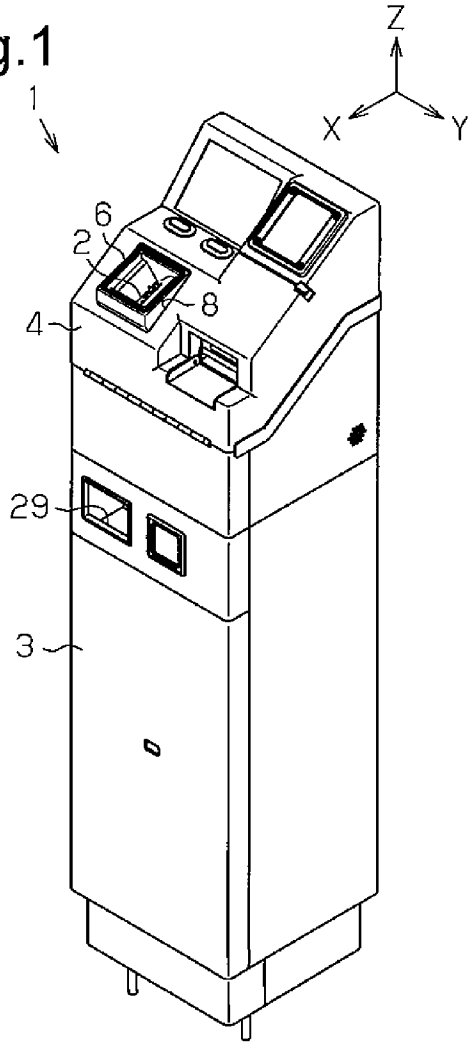
FIG. 1 is a perspective view showing one embodiment of a farebox.

As shown in FIG. 1, a farebox 1 includes a coin slot 2 that is a slot for coins, or fares. The coin slot 2 is located in, for example, the upper portion of the farebox 1. The farebox 1 includes a housing 3, which serves as a body, and a lid 4, which opens and closes an upper opening of the housing 3. The lid 4 includes, for example, a lock 5 (shown in FIG. 2). The lock 5 is opened with a key to allow the lid 4 to be opened and closed.

Figure 2:
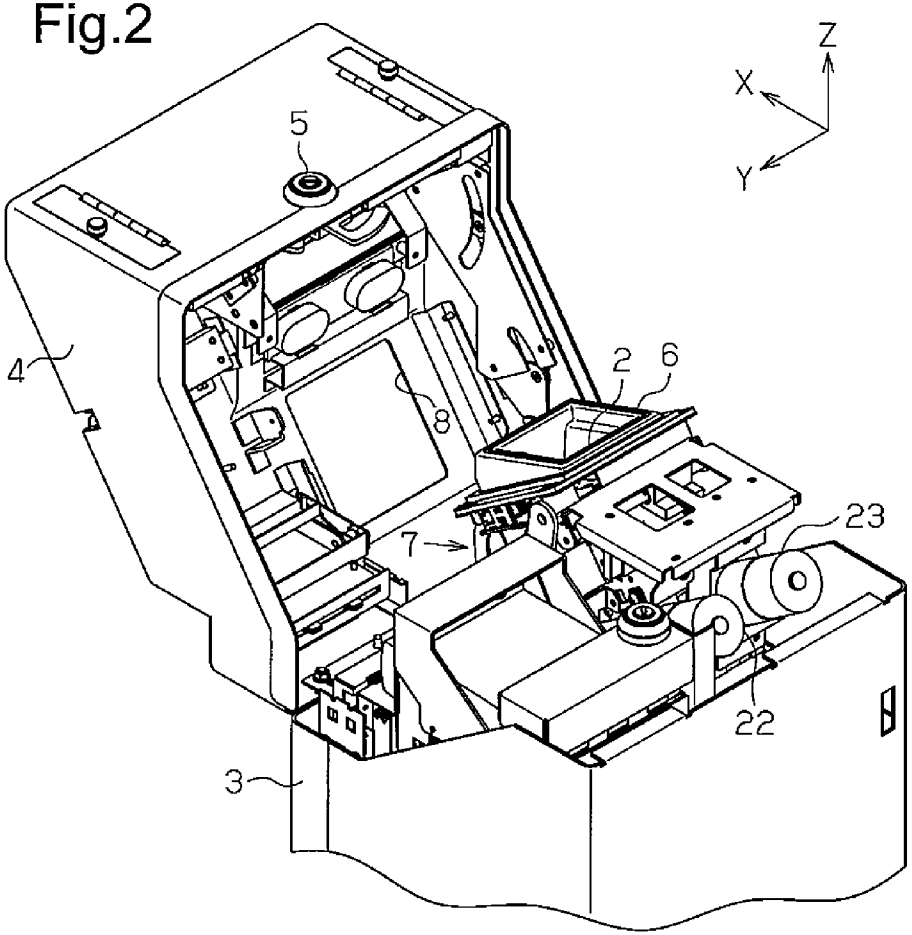
FIG. 2 is a perspective view showing the internal structure of the farebox.

As shown in FIG. 2, the farebox 1 includes a coin recognition machine 6, which recognizes the types of coins received from the coin slot 2. It is preferred that the coin recognition machine 6 be accommodated in a removable manner in an accommodation portion 7, which is defined in the housing 3. It is preferred that the coin slot 2 be arranged above the coin recognition machine 6. It is preferred that the lid 4 include an opening 8 to expose the coin slot 2 of the coin recognition machine 6, which is set in the accommodation portion, to the outside when the lid 4 is closed.

Figure 3B:
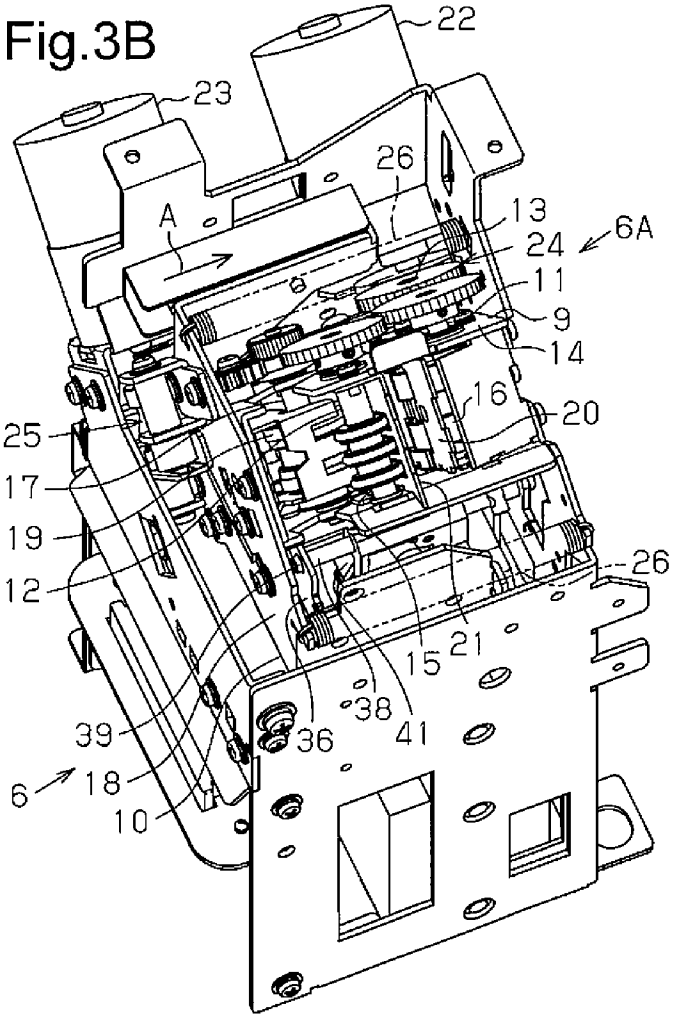
FIG. 3A is a perspective view showing a second coin guide when located at a narrow position and FIG. 3B is a perspective view showing the second coin guide when located at a wide position.
Figure 3A:
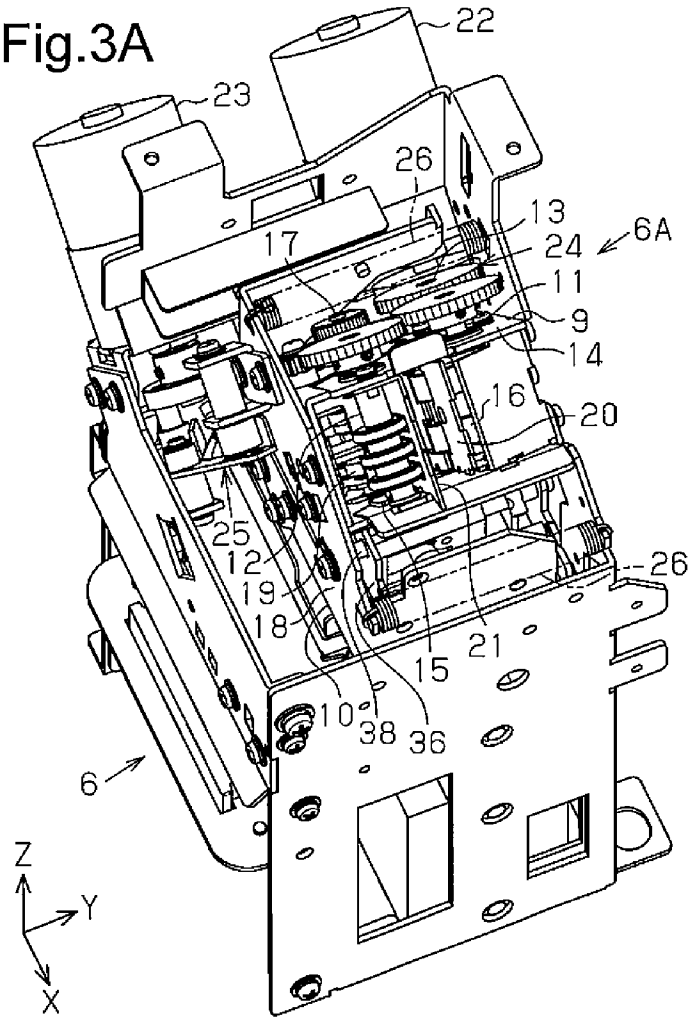

As shown in FIGS. 3A and 3B, the coin recognition machine 6 includes a coin aligner 6A, which downwardly feeds a specified number of coins received by the coin recognition machine 6. The coin aligner 6A includes a first coin guide 9 and a second coin guide 10. The first coin guide 9 is fixed at a predetermined position. The second coin guide 10 is movable toward and away from the first coin guide 9 in a predetermined direction. It is preferred that the first coin guide 9 include rectifying rollers 15, which rectify received coins, and feed rollers 16, which downwardly feed the rectified coins. The rectifying rollers 15 may be rotationally supported by a rotation shaft 12 on a frame 14 of the first coin guide 9. The feed rollers 16 may be rotationally supported by a rotation shaft 13 on the frame 14 of the first coin guide 9. The coin recognition machine 6 may detect a rotation amount of the rotation shaft 11 with a sensor 58 (refer to FIG. 6) to detect the rotation speeds of the rotation shafts 11 to 13. The rotation shafts 11 and 12 are arranged in a widthwise direction of the coin recognition machine 6 (Y-axis direction in FIG. 3), and the rotation shafts 11 and 13 are arranged in a height-wise direction of the coin recognition machine 6 (Z-axis direction in FIG. 3).

It is preferred that the second coin guide 10 include reverse rollers 19, which rotate in the direction opposite to the rotation of the feed rollers 16. It is preferred that the reverse rollers 19 be rotationally supported by a single rotation shaft 17 on a frame 18 of the second coin guide 10. The rotation shaft 17 is arranged next to the rotation shaft 13 in the widthwise direction of the coin recognition machine 6. Coins received from the coin slot 2 enter the coin recognition machine 6 through the gaps between the feed rollers 16 and the reverse rollers 19 and between a passage wall 20 of the first coin guide 9 and a passage wall 21 of the second coin guide 10.

The second coin guide 10 is coupled to a frame of the coin recognition machine 6 to be movable toward and away from the first coin guide 9. This moves the second coin guide 10 between a narrow position (as shown in FIG. 3A), which is close to the first coin guide 9, and a wide position (as shown in FIG. 3B), which is separated from the first coin guide 9. It is preferred that the second coin guide 10 linearly reciprocate in the widthwise direction of the coin recognition machine 6. When coins are jammed between the feed rollers 16 and the reverse rollers 19, the second coin guide 10 moves from the narrow position to the wide position to widen the gap between the feed rollers 16 and the reverse rollers 19. This drops the jammed coins from between the feed rollers 16 and the reverse rollers 19.

It is preferred that the coin recognition machine 6 include a first motor 22, which serves as a drive source for the rotation shafts 11 to 13 and 17 (rectifying roller 15, feed roller 16, and reverse roller 19), and a second motor 23, which serves as a drive source for reciprocating the second coin guide 10. It is preferred that the first motor 22 be located near the frame 14 and that the second motor 23 be located near the frame 18. For example, the first motor 22 is coupled to the rotation shafts 11 to 13 and 17 by a gear mechanism 24, which includes a plurality of gears. The second motor 23 is coupled to the frame 18 of the second coin guide 10 by a coupling mechanism 25. The coupling mechanism 25 is configured to linearly reciprocate the second coin guide 10 in accordance with the drive of the second motor 23. It is preferred that the second coin guide 10 include two biasing portions 26, which normally bias the second coin guide 10 in a narrowing direction (direction of arrow A in FIG. 3B). For example, the biasing portions 26 include a coil spring.

Figure 4:
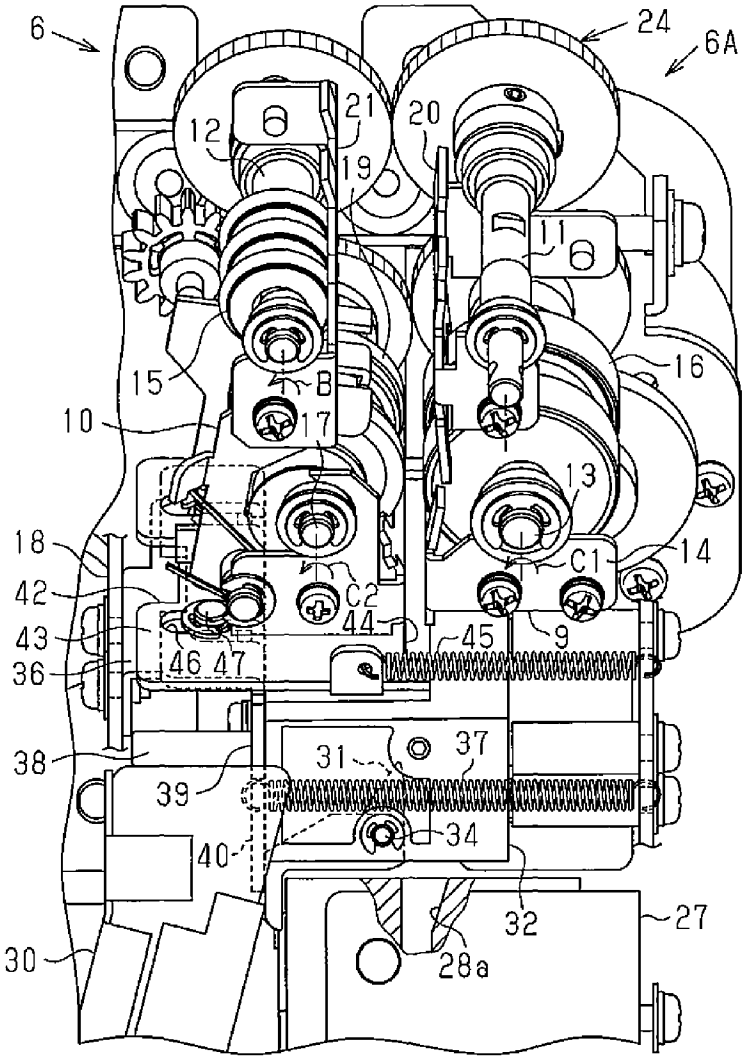
FIG. 4 is a partially enlarged perspective view showing the internal structure of the coin recognition machine.

Referring to FIG. 4, the rectifying rollers 15 preferably rotate in a direction that upwardly repels the falling coins (direction of arrow B in FIG. 4). The feed rollers 16 preferably rotate in a direction that drops the coins that have passed by the rectifying rollers 15 (direction of arrow C1 in FIG. 4). The reverse rollers 19 rotate in a direction that lifts the coins, that is, the same rotation direction as the feed rollers 16 (direction of arrow C2 in FIG. 4).

Figure 5:
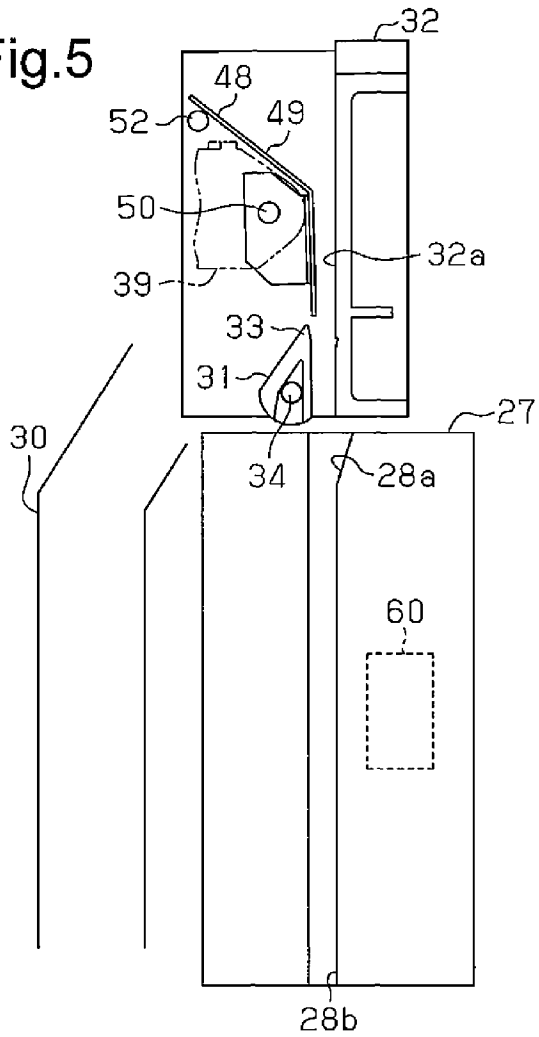
FIG. 5 is a diagram showing the surroundings of a shutter, a coin recognition unit, and a coin chute.
Figure 6A:
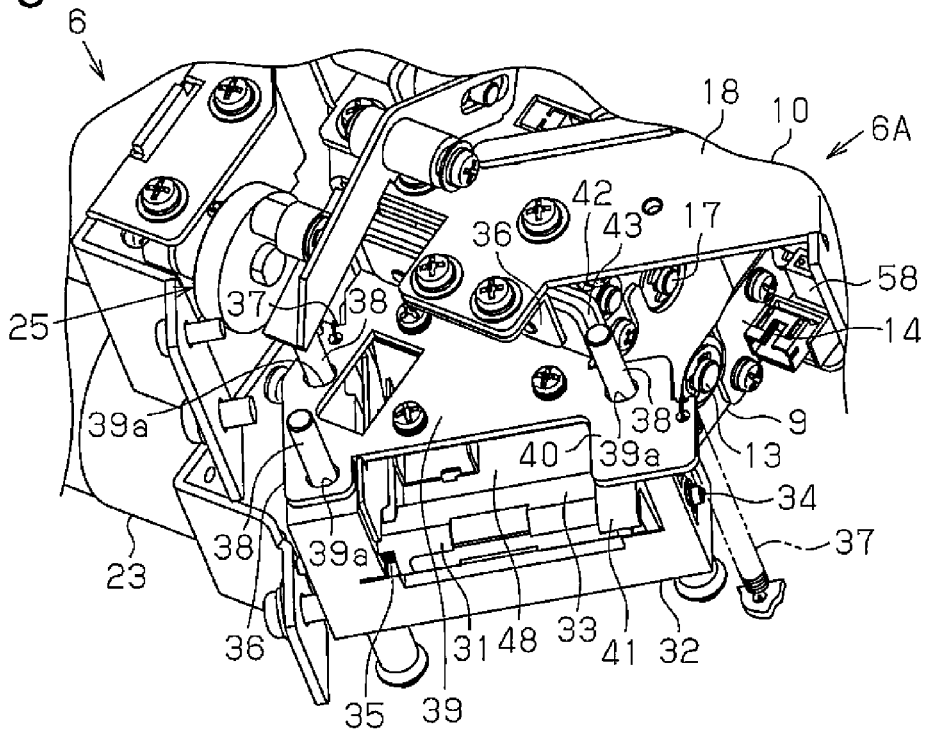
FIG. 6A shows the second coin guide when located at the narrow position and FIG. 6B shows the second coin guide when located at the wide position.
Figure 6B:
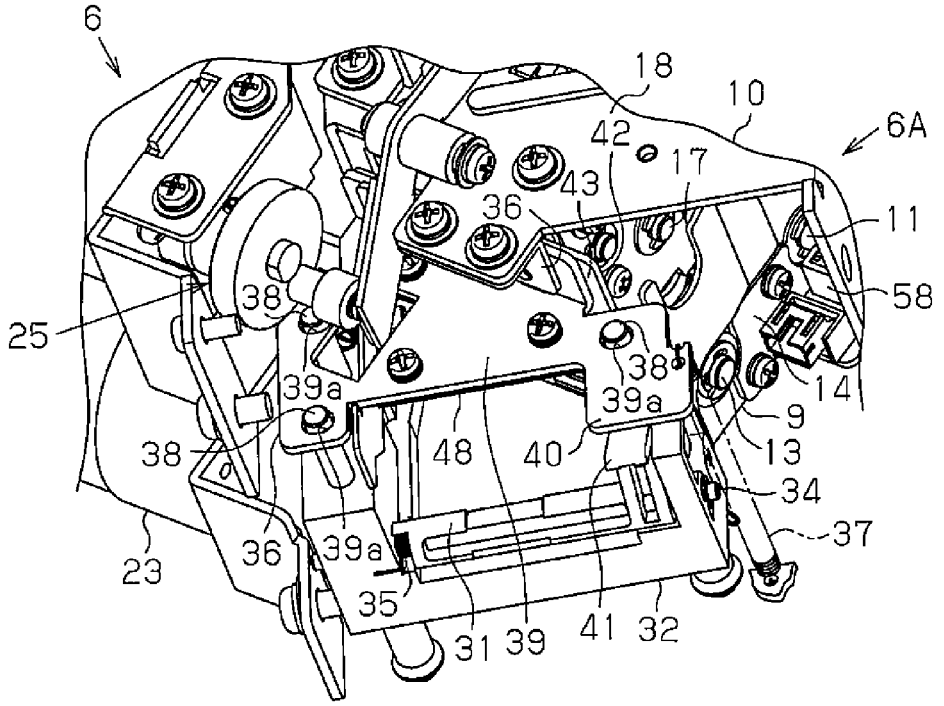

As shown in FIGS. 5, 6A, and 6B, the coin recognition machine 6 includes a shutter 31, which covers a coin inlet 28*a* of a coin recognition unit 27 (refer to FIG. 5) when the second coin guide 10 is located at the wide position. The shutter 31 moves in accordance with the position of the second coin guide 10 between an open position (state shown in FIGS. 5 and 6A), where the coin inlet 28*a* is open and allows coins to be fed to the coin recognition unit 27, and a closed position (state shown in FIG. 6B), where the coin inlet 28*a* is covered and does not allow coins to be fed to the coin recognition unit 27. For example, the shutter 31 is located at the open position (state shown in FIGS. 5 and 6A) when the second coin guide 10 is located at the narrow position (as shown in FIG. 6B), and the shutter 31 is located at the closed position when the second coin guide 10 is located at the wide position. For example, it is preferred that the shutter 31 move from the open position to the closed position when the second coin guide 10 moves from the narrow position to the wide position.

As shown in FIG. 5, it is preferred that the coin recognition unit 27 include the coin inlet 28*a*, which is located in the upper surface of the coin recognition unit 27, a coin outlet 28*b*, which is located in the bottom surface of the coin recognition unit 27, and a coin detector 60, which is located in the coin recognition machine 6. It is desired that the coin detector 60 be located below the coin aligner 6A, which includes the first coin guide 9 and the second coin guide 10, in the coin recognition machine 6. For example, the coin recognition unit 27 recognizes the value of a coin or distinguishes an official coin from an unacceptable or unknown coin such as a foreign coin. It is preferred that the coin recognition machine 6 include a coin chute 30, which is located at a side of the coin recognition machine 6. The coin chute 30 guides the coins that fall when the second coin guide 10 is located at the wide position to a coin return slot 29 (refer to FIG. 1) of the farebox 1.

Figure 7:
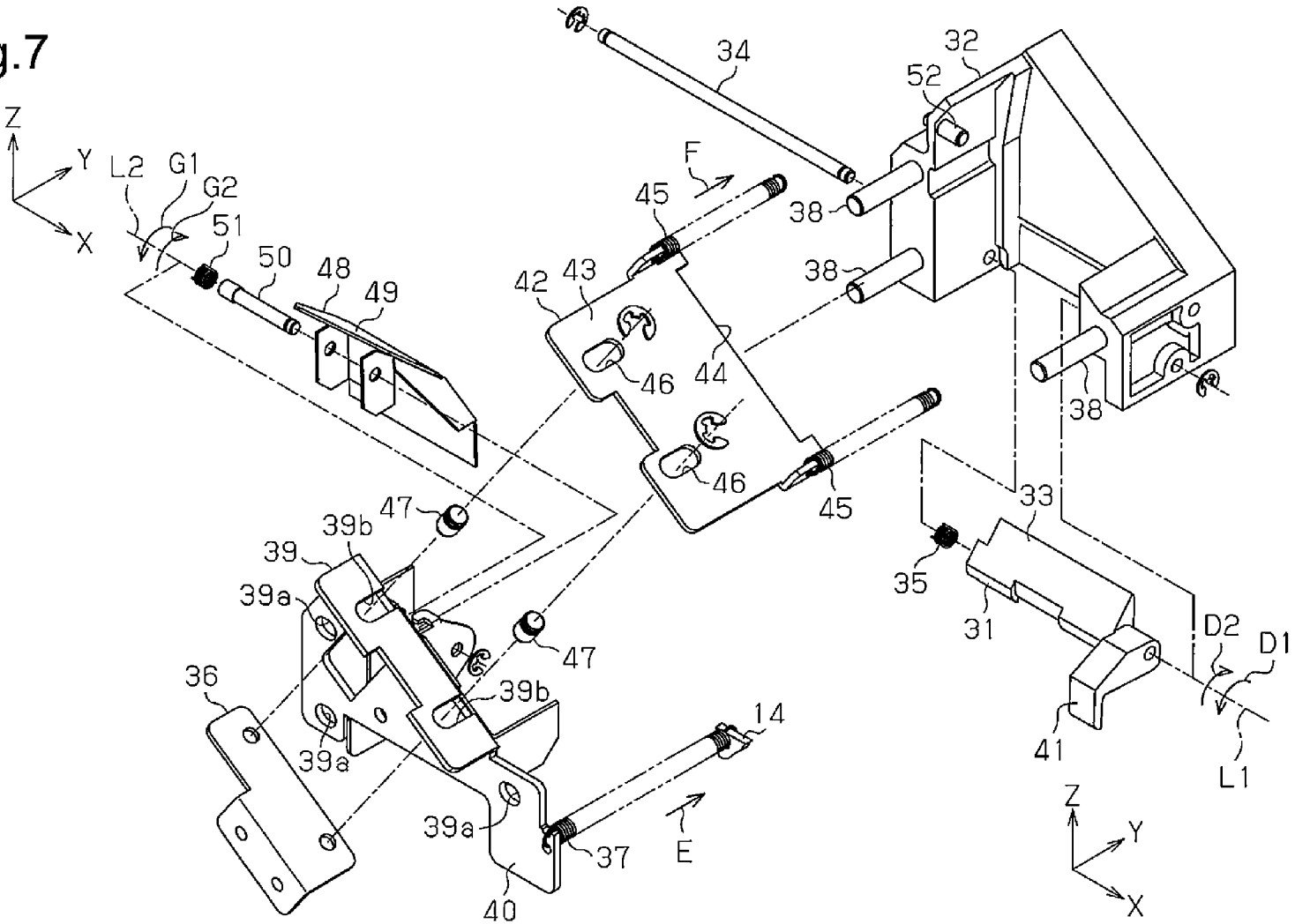
FIG. 7 is an exploded perspective view showing the shutter and its surrounding components.

As shown in FIG. 7, it is preferred that the shutter 31 be pivotally coupled to a block 32, which is fixed to the inner side of the frame 14. For example, the block 32 is located above the coin recognition unit 27 at the inner side of the frame 14. It is preferred that the shutter 31 include a valve 33, which opens and closes the coin inlet 28*a* of the coin recognition unit 27, a shaft 34, which functions as a pivot shaft of the shutter 31, and a biasing portion 35, which normally biases the valve 33 in a direction closing the coin inlet 28*a* (direction of arrow D2 in FIG. 7). The two ends of the shaft 34 are supported by the block 32. For example, it is preferred that the shutter 31 be pivoted about an axis L1, which extends in a lengthwise direction of the coin recognition machine 6 (direction of X-axis in FIG. 7). For example, the valve 33 substantially has the form of a plate, and the biasing portion 35 includes a torsion spring.

It is preferred that a sliding frame 39 be fixed to the frame 18 of the second coin guide 10 so that the frame 18 is adjacent to the block 32. It is preferred that the sliding frame 39 be arranged at a widthwise end of the frame 18. It is preferred that a biasing portion 37, which normally biases the sliding frame 39 toward the frame 18 (direction of arrow E in FIG. 7), be attached to the sliding frame 39. The biasing portion 37 is, for example, a coil spring. One end of the biasing portion 37 is engaged with the sliding frame 39, and the other end of the biasing portion 37 is engaged with the frame 14 of the first coin guide 9. In the embodiment, the single biasing portion 37 is attached to the sliding frame 39. Instead, a plurality of biasing portions 37 may be attached to the sliding frame 39. Guiding shafts 38 may project from a side wall of the block 32 in the movement direction of the second coin guide 10 (Y-axis direction in FIG. 7), and through holes 39*a* may extend through the sliding frame 39. The guiding shafts 38 are respectively inserted into the through holes 39*a*. It is preferred that the sliding frame 39 include a pressing portion 40. The pressing portion 40 abuts against the shutter 31 to switch the shutter 31 between open and closed states. It is preferred that a side of the shutter 31 include a lever 41, which contacts the pressing portion 40.

It is preferred that the coin recognition machine 6 include a passage width adjustor 42, which maintains a coin passage 62 (shown in FIG. 14B) at a normal passage width when moving the second coin guide 10 from the narrow position to the wide position. The coin passage 62 is arranged, for example, so that the first coin guide 9 and the second coin guide 10 are located on the opposite side of the coin passage 62 from the coin inlet 28*a*. The passage width adjustor 42 adjusts, for example, a passage width of at least a portion of the coin passage 62 in accordance with the position of the second coin guide 10. The passage width adjustor 42 adjusts a passage width of at least a portion of the coin passage 62 to a first passage width when the second coin guide 10 is located at the narrow position and adjusts a passage width of at least a portion of the coin passage 62 to a second passage width, which is larger than the first passage width, when the second coin guide 10 is located at the wide position. The passage width adjustor 42 maintains the first passage width of the coin passage 62 until a predetermined period elapses from when the second coin guide 10 starts to move from the narrow position to the wide position. It is preferred that the passage width adjustor 42 include an opening/closing plate 43, which reciprocates in the widthwise direction of the coin recognition machine 6, and a biasing portion 45, which normally biases the opening/closing plate 43 in a closing direction (direction of arrow F in FIG. 7). It is preferred that one end of the opening/closing plate 43 include a slit 44, which allows passage of a single coin between the block 32 and the opening/closing plate 43 when the opening/closing plate 43 abuts against the block 32. The slit 44 is a recess located at one end of the opening/closing plate 43. The slit 44 is elongated and cut out from one side of the opening/closing plate 43 for a predetermined depth. For example, the predetermined depth includes a slight margin to the thickness of a single coin.

Two elongated holes 46 are located at positions close to the other end of the opening/closing plate 43. Further, a boss base 36, which moves with the second coin guide 10, is fixed to the frame 18 of the second coin guide 10. Two projections 47 project from the boss base 36. The projections 47 may be respectively inserted into elongated holes 39*b* of the sliding frame 39 and the elongated holes 46. This allows each of the sliding frame 39 and the opening/closing plate 43 to be independently coupled to the boss base 36 in a slidable manner. The elongated holes 39*b* are, for example, shorter than the elongated holes 46. The biasing portion 45 includes, for example, two coil springs.

It is preferred that the coin recognition machine 6 include an auxiliary coin guide 48, which switches the guiding direction of received coins in accordance with the position of the second coin guide 10. The auxiliary coin guide 48 is arranged, for example, so that the first coin guide 9 and the second coin guide 10 are located on the opposite side of the auxiliary coin guide 48 from the shutter 31. It is preferred that the auxiliary coin guide 48 include a guiding wall 49, which forms a passage for coins, a shaft 50, which functions as a pivot shaft of the guiding wall 49, and a biasing portion 51, which normally biases the guiding wall 49 in a direction the guiding wall 49 extends upright (direction of arrow G1 in FIG. 7). For example, it is preferred that the auxiliary coin guide 48 be pivoted about an axis L2, which extends in the lengthwise direction of the coin recognition machine 6. It is preferred that the inner wall of the block 32 include a projection 52, which presses the guiding wall 49 in a direction the guiding wall 49 extends horizontally (direction of arrow G2 in FIG. 7) when the second coin guide 10 is located at the wide position. The biasing portion 51 includes, for example, a torsion spring. For example, it is preferred that the auxiliary coin guide 48 be located at a first guiding position (as shown in FIG. 6A), which guides coins to the coin recognition unit 27 when the second coin guide 10 is located at the narrow position, and be located at a second guiding position (as shown in FIG. 6B), which guides coins to the coin chute 30 when the second coin guide 10 is located at the wide position.

Figure 8:
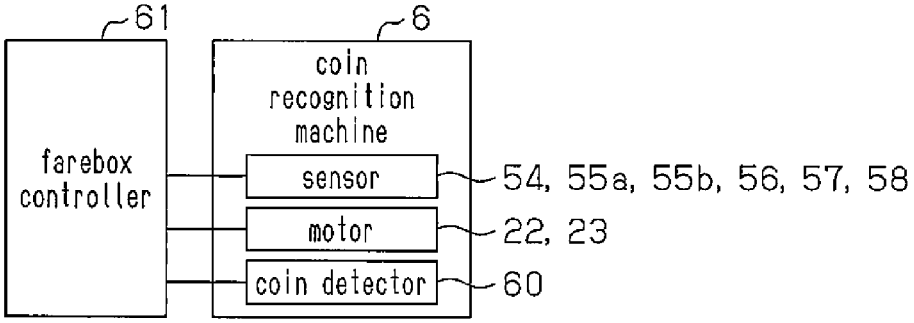
FIG. 8 is a diagram showing the electric configuration of the coin recognition machine.

As shown in FIG. 8, it is preferred that the coin recognition machine 6 include sensors 54 to 58. The sensor 54 detects passage of coins near the coin slot 2 and detects when the coins have been received from the coin slot 2. The sensor 55*a* detects the passage of coins near the coin aligner 6A, for example, below the feed rollers 16 and the reverse rollers 19, to detect when the coins are jammed between the feed roller 16 and the reverse roller 19. The sensor 55*b* detects passage of coins near the passage width adjustor 42, for example, below the slit 44, to detect when the coins are jammed in the slit 44. The sensor 56 detects that the second coin guide 10 is located at the narrow position. The sensor 57 detects that the second coin guide 10 is located at the wide position. The sensor 58 detects rotation of the group of rotation shafts. Various types of sensors such as an optical sensor and a magnetic sensor may be used as the sensors 54 to 58. It is preferred that the coin recognition machine 6 include the coin detector 60, which detects the types of coins.

It is preferred that the sensors 54 to 59, the first motor 22, the second motor 23, and the coin detector 60 be controlled by a farebox controller 61 arranged in the farebox. Based on detection signals provided from the sensors 54 to 58 and the coin detector 60, the farebox controller 61 controls the first motor 22 and the second motor 23 to perform various operations such as coin recognition.

The operation of the coin recognition machine 6 will now be described with reference to FIGS. 3 and 9 to 14.

Normal Coin Recognition Operation

Figure 9A:
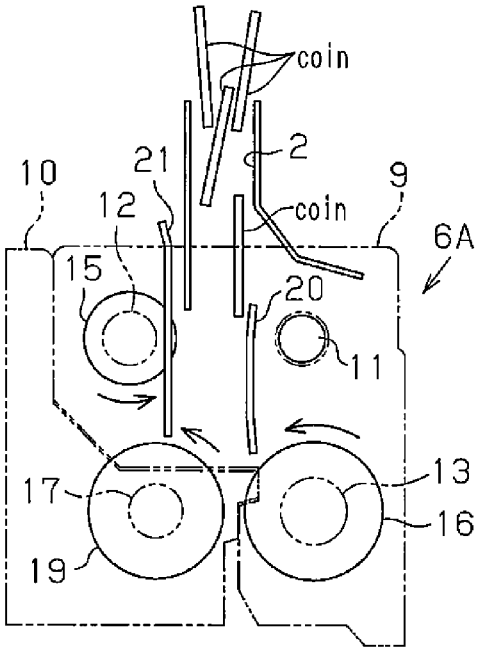
FIGS. 9A to 9C are operation diagrams showing a first coin guide and the second coin guide of the narrow position that feed coins downward.
Figure 9B:
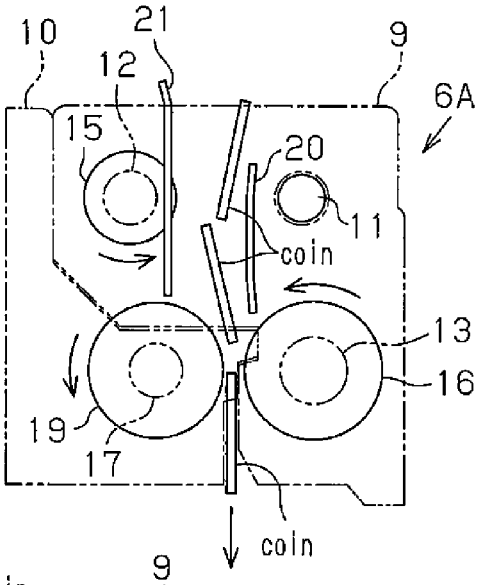

As shown in FIG. 9A, the second coin guide 10 of the coin recognition machine 6 is normally located at the narrow position. A plurality of coins may be simultaneously inserted into the coin slot 2. In such a case, when the sensor 54 detects that the coins have been received from the coin slot 2, the farebox controller 61 starts driving the first motor 22. This starts rotation of the rectifying rollers 15, the feed rollers 16, and the reverse rollers 19. As shown in FIG. 9B, the coins received from the coin slot 2 fall down one at a time between the feed rollers 16 and the reverse rollers 19.

Figure 9C:
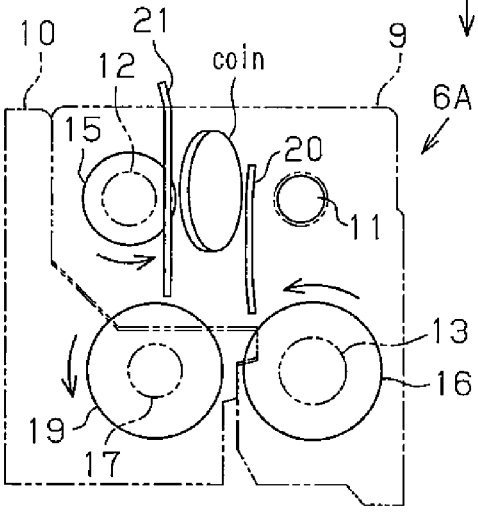

As shown in FIG. 9C, when a coin falls sideways, the rectifying rollers 15 correct the direction of a coin before feeding the coin to the feed rollers 16 and the reverse rollers 19.

When two or more coins simultaneously enter the gap between the feed rollers 16 and the reverse rollers 19, the two coins press the feed roller 16 and the reverse roller 19. This slightly moves the second coin guide 10 toward the wide position against the biasing force of the biasing portion 26 so that the two coins are simultaneously received between the feed rollers 16 and the reverse rollers 19. One of the two coins is fed downward by the feed rollers 16, and the other one is lifted by the reverse roller 19. Thus, only the one coin that is fed downward passes between the feed roller 16 and the reverse roller 19 and falls. The second coin guide 10 moves from the wide position to the narrow position in accordance with the biasing force of the biasing portion 26. When the second coin guide 10 is pressed by the coins and slightly moved to the wide position in such a manner, each projection 47 slides in the corresponding elongated hole 39*b* and the corresponding elongated hole 46. In this case, as will be described later, the shutter 31 is not located at the closed position, and the passage width adjustor 42 is not located at the wide position.

Figure 10:
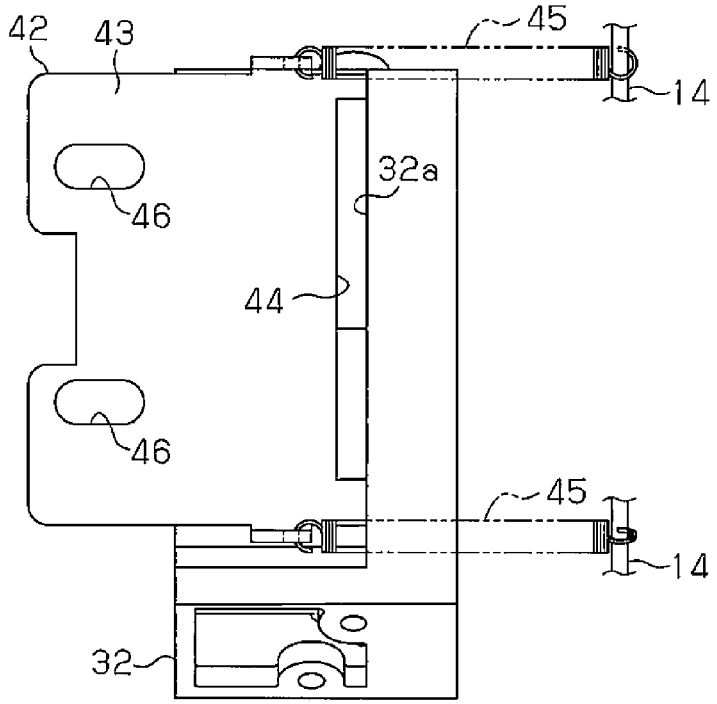
FIG. 10 is an external view showing a passage width adjustor located at the narrow position.

Referring to FIG. 10, the passage width adjustor 42 moves between the narrow position, at which the passage width adjustor 42 abuts against an inner wall 32*a* of the block 32, and the wide position, at which the passage width adjustor 42 is separated from the inner wall 32*a* of the block 32. When the second coin guide 10 is located at the narrow position, the passage width adjustor 42 is located at the narrow position and abuts against the inner wall 32*a* of the block 32. In such a case, coins that have passed between the first coin guide 9 and the second coin guide 10 are fed downward through only the slit 44 of the passage width adjustor 42. Thus, the coins are fed one at a time to below the passage width adjustor 42.

Figure 11A:
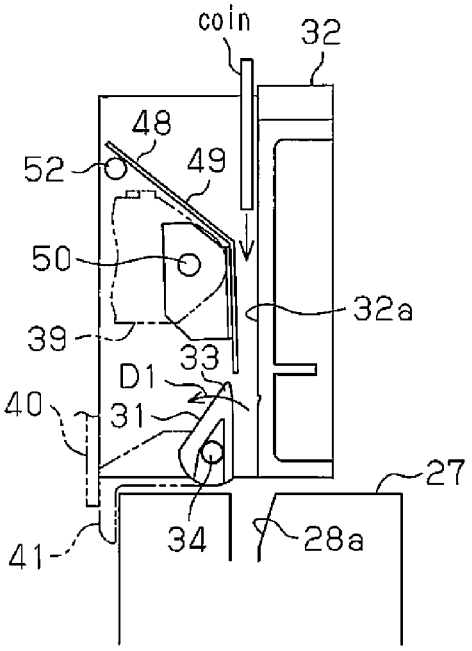
FIGS. 11A and 11B are operation diagrams showing the shutter and an auxiliary coin guide that feed coins downward when the second coin guide is located at the narrow position.
Figure 11B:
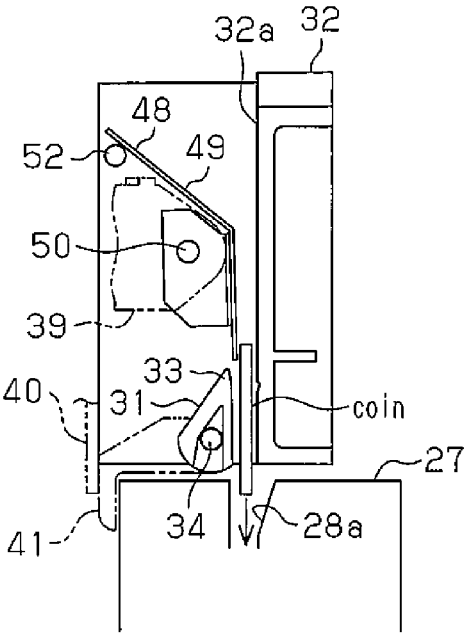

As shown in FIG. 11A, when the second coin guide 10 is located at the narrow position, the auxiliary coin guide 48 is located at the first guiding position to guide coins to the coin recognition unit 27, and the shutter 31 is pressed by the pressing portion 40 and located at the open position. Thus, the coins that pass through the slit 44 of the passage width adjustor 42 pass through a passage defined by the shutter 31 and the auxiliary coin guide 48 on one side and the inner wall 32*a* on the opposite side before falling. As shown in FIG. 11B, the coins pass through the shutter 31 and reach the coin inlet 28*a* of the coin recognition unit 27. The coin recognition unit 27 receives the coins that reach the coin inlet 28*a* and identifies the type of each received coin. The coin recognition unit 27 discharges the recognized coins from the coin outlet 28*b*. The discharged coins enter a safe (not shown) located in the farebox 1.

Removal of Jammed Coin

Figure 12A:
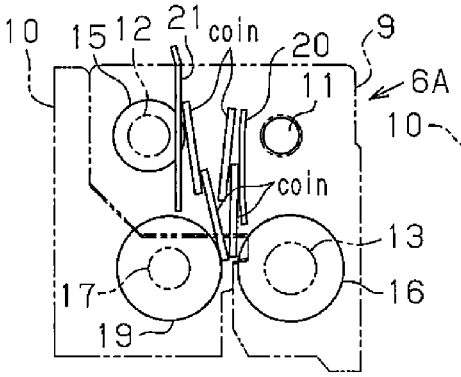
FIGS. 12A and 12B are operation diagrams showing the second coin guide when located at the wide position.
Figure 12B:
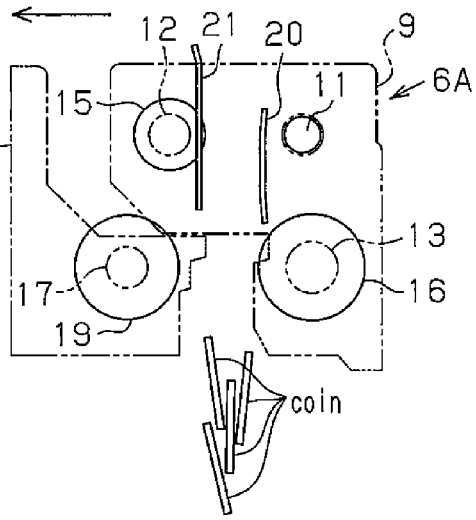

As shown in FIG. 12A, when the farebox controller 61 detects with, for example, the sensor 55*a* or the sensor 55*b* that coins have been jammed between the first coin guide 9 and the second coin guide 10, the farebox controller 61 drives the second motor 23 to move the second coin guide 10 from the narrow position to the wide position. As shown in FIG. 12B, when the second coin guide 10 is located at the wide position, the gap between the first coin guide 9 and the second coin guide 10 is widened. This drops the coins jammed between the first coin guide 9 and the second coin guide 10.

Figure 13A:
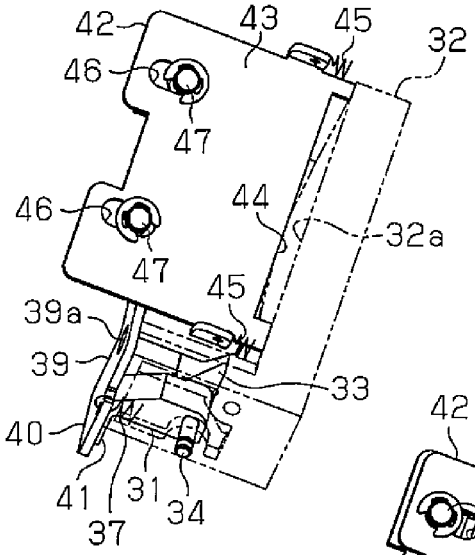
FIGS. 13A to 13C are operation diagrams showing the shutter and the passage width adjustor when the second coin guide is located at the wide position.
Figure 13B:
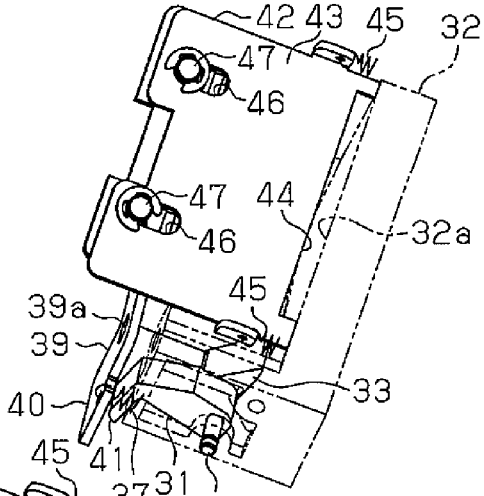

When the second coin guide 10 moves from the narrow position shown in FIG. 13A to the wide position shown in FIG. 13B, the boss base 36 starts to move with the frame 18. In such a case, the sliding frame 39 is biased by the biasing force of the biasing portion 37 toward the block 32, and the passage width adjustor 42 is biased by the biasing force of the biasing portion 45 toward the block 32. This holds the positions of the sliding frame 39 and the passage width adjustor 42. Further, since each projection 47 is movable in the corresponding elongated hole 39*b* and the corresponding elongated hole 46, the passage width adjustor 42 is maintained at the narrow position even when the boss base 36 is moving. Each elongated hole 39*b* is shorter than each elongated hole 46. Thus, when each projection 47 moves in the corresponding elongated hole 39*b* and the corresponding elongated hole 46, the projection 47 abuts against an end of the elongated hole 39*b* before abutting against an end of the elongated hole 46. More specifically, each projection 47 moves from one end of the elongated hole 39*b* and one end of the elongated hole 46 and abuts against the other end of the elongated hole 39*b*. When each projection 47 abuts against the other end of the elongated hole 39*b*, the projection 47 pushes the sliding frame 39, moves from the other end of the elongated hole 39*b*, and abuts against the other end of the elongated hole 46. Thus, when the shutter 31 moves from the open position to the closed position as the second coin guide 10 moves from the narrow position to the wide position, the passage width adjustor 42 starts to move away from the block 32 later than the sliding frame 39. The delayed time is determined by the difference in length of the elongated hole 39*b* and the elongated hole 46, the size of the projection 47, and the movement speed of the boss base 36. The delayed separation of the passage width adjustor 42 from the block 32 moves the shutter 31 from the open position to the closed position before the passage width adjustor 42 starts to move from the narrow position to the wide position.

Figure 13C:
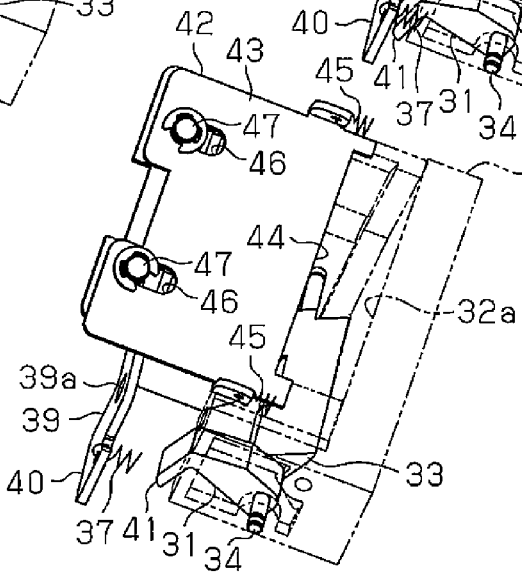

As shown in FIG. 13C, when the second coin guide 10 is separated from the first coin guide 9 by a certain distance, each projection 47 abuts against the end of the corresponding elongated hole 46 and pushes the passage width adjustor 42. Thus, the passage width adjustor 42 starts to linearly move with the boss base 36 and separates the passage width adjustor 42 from the inner wall 32*a* of the block 32. This widens the gap of the passage width adjustor 42 and the block 32 so that the coins jammed in the coin aligner 6A fall simultaneously.

Figure 14A:
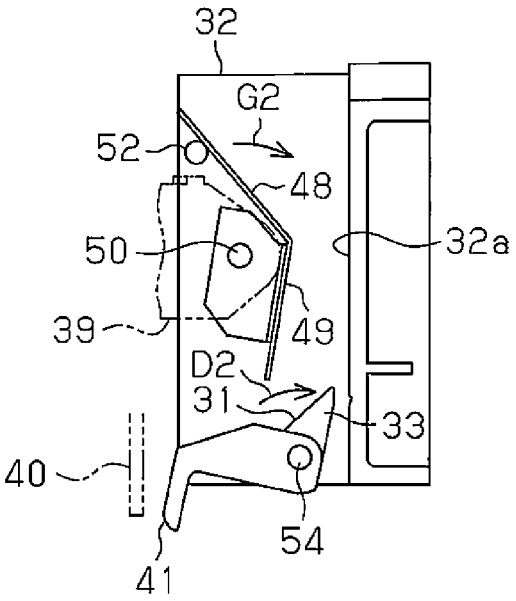
FIGS. 14A and 14B are operation diagrams showing the shutter and the auxiliary coin guide when the second coin guide is located at the wide position.

As shown in FIG. 14A, when the second coin guide 10 moves from the narrow position to the wide position, the projections 52 push the auxiliary coin guide 48. This starts pivoting the auxiliary coin guide 48 against the biasing force of the biasing portion 51 in a direction that moves the auxiliary coin guide 48 to extend horizontally (direction of arrow G2 in FIG. 14A). Further, when the second coin guide 10 moves from the narrow position to the wide position, the pressing portion 40 is separated from the lever 41. This starts pivoting of the shutter 31 with the biasing force of the biasing portion 35 toward the closed position (direction of arrow D2 in FIG. 14A).

Figure 14B:
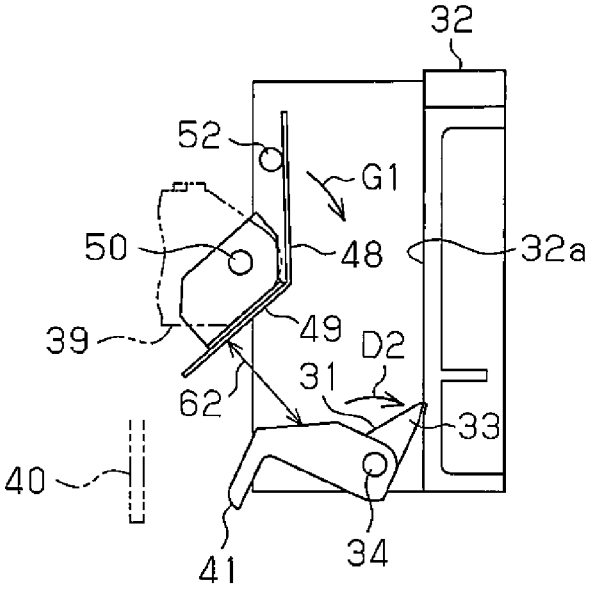

As shown in FIG. 14B, when the second coin guide 10 is located at the wide position, the shutter 31 is located at the closed position and the auxiliary coin guide 48 is located at the second guiding position. Thus, coins that pass between the feed roller 16 and the reverse roller 19 are fed to the coin chute 30 through the coin passage 62, which is defined by a side wall of the shutter 31 and a side wall of the auxiliary coin guide 48, without reaching the coin recognition unit 27. The coins are then discharged from the coin return slot 29 through the coin chute 30 to the outside.

As shown in FIG. 3B, after a certain time elapses from when the second coin guide 10 moves to the wide position, the farebox controller 61 reverses the second motor 23 and returns the second coin guide 10 to the original narrow position shown in FIG. 3A. In such a case, the shutter 31 is returned from the closed position to the open position, the auxiliary coin guide 48 is returned to the first guiding position, and the passage width adjustor 42 is returned to the narrow position. When the second coin guide 10 returns to the narrow position, the first coin guide 9 and the second coin guide 10 move toward each other to allow passage of only a single coin through the gap between the first coin guide 9 and the second coin guide 10 as described above so that coins are fed one at a time. This allows the coin recognition machine 6 to restart the coin recognition operation.

The present embodiment has the advantages described below.

(1) The shutter 31 is arranged in a coin-feeding path of the coin recognition machine 6. When the second coin guide 10 is separated from the first coin guide 9 to drop jammed coins, the shutter 31 is located at the closed position so that the coin inlet 28*a* of the coin recognition unit 27 is covered by the shutter 31. Thus, coins are less likely to simultaneously enter the coin inlet 28*a* of the coin recognition unit 27. This reduces coin jamming in the coin inlet 28*a* of the coin recognition unit 27.

(2) The shutter 31 is arranged at the closed position when the second coin guide 10 moves to the wide position. Thus, when the second coin guide 10 starts to move to the wide position, the shutter 31 starts to move to the closed position in accordance with the movement. This allows the shutter 31 to start moving to the closed position at an optimal time.

(3) The coin recognition machine 6 includes the passage width adjustor 42. Even after the shutter 31 starts to move to the closed position, the passage width adjustor 42 is maintained at the same state for a while so that the passage width of coins remains normal, that is, the passage width for only a single coin to pass. This allows the shutter 31 to be located at the closed position in advance before a group of jammed coins fall together. Thus, when the shutter 31 is closed completely, the falling coins are less likely to be jammed.

(4) The coin recognition machine 6 includes the auxiliary coin guide 48. When the second coin guide 10 is located at the narrow position, the auxiliary coin guide 48 of the first guiding position guides falling coins to the coin recognition unit 27. When the second coin guide 10 is located at the wide position, the auxiliary coin guide 48 of the second guiding position guides falling coins to the coin chute 30. Thus, the auxiliary coin guide 48 allows falling coins to be fed in a suitable direction.

The embodiment is not limited to the above structure and may be modified as described below.

The shutter 31 does not have to completely cover the coin inlet 28*a* of the coin recognition unit 27 as long as coins do not enter the coin inlet 28*a*. For example, the coin inlet 28*a* may be partially covered to restrict inlet of a coin.

The shutter 31 does not have to be a pivotal member. Instead, the shutter 31 may be a sliding member that linearly reciprocates.

The shutter 31 may be normally biased, for example, in the opening direction. In such a case, when the second coin guide 10 moves to the wide position, the second coin guide 10 is pressed toward the closed position in accordance with the movement and is moved to the closed position.

The number of the elongated holes 46 of the passage width adjustor 42 does not have to be two. Instead, the number of the elongated holes 46 may be, for example, one or three.

The passage width adjustor 42 does not have to be a sliding member that linearly reciprocates. Instead, the passage width adjustor 42 may be a pivotal member pivoted about an axis.

The passage width adjustor 42 may be normally biased, for example, in the widening direction. In such a case, when the second coin guide 10 is moved to the wide position, a certain restriction may be released so that a biasing portion switches the second coin guide 10 to the wide position.

The auxiliary coin guide 48 is not limited to a pivotal member. Instead, the auxiliary coin guide 48 may be a sliding member that linearly reciprocates.

The auxiliary coin guide 48 may be normally biased, for example, in the direction of the second guiding position. In such a case, when the second coin guide 10 is moved to the wide position, a certain restriction may be released so that a biasing portion switches the second coin guide 10 to the second guiding position.

The shutter 31 does not have to be closed when the second coin guide 10 moves to the wide position. That is, the shutter 31 may be closed independently from the operation of the second coin guide 10 so that the shutter 31 solely moves to the closed position.

The opening and closing of the shutter 31 may be switched by a drive source such as an actuator (for example, motor or solenoid).

The structures of the first coin guide 9 and the second coin guide 10 may be changed to structures that are not described in the embodiment.

The farebox 1 may be configured such that the coin return slot 29 discharges coins used for change or coins exchanged with paper money received in a bill slot.

The farebox 1 may be capable of performing fare adjustment using, for example, a magnetic card or an IC card.

When coins are jammed, the jamming may be notified on a display of the farebox 1.

The coin recognition machine 6 does not have to be applied to the farebox 1. Instead, the coin recognition machine 6 may be applied to other devices, for example, a ticket machine that sells admission tickets or train tickets and a vending machine that sells beverages or cigarettes. In addition, the coin recognition machine 6 may be applied to any device that includes a coin slot configured to receive a plurality of coins simultaneously.

What is claimed is:

1. A coin recognition machine comprising:

a coin aligner including a first coin guide and a second coin guide, wherein the second coin guide moves between a narrow position that is close to the first coin guide and a wide position that is separated from the first coin guide, and the coin aligner is configured such that a specified number of coins fall from between the first coin guide and the second coin guide;

a coin inlet that receives a coin falling from between the first coin guide and the second coin guide, wherein the coin inlet is located below the first coin guide and the second coin guide, wherein when a coin is jammed between the first coin guide and the second coin guide, the coin aligner moves the second coin guide from the narrow positon to the wide position to widen a gap between the first coin guide and the second coin guide so that the jammed coin falls;

a shutter that covers the coin inlet when the second coin guide is located at the wide position;

a coin passage, wherein the first coin guide and the second coin guide are located at an opposite side of the coin passage from the coin inlet; and a passage width adjustor that adjusts a passage width of at least a portion of the coin passage in accordance with a position of the second coin guide.

2. The coin recognition machine according to claim 1, wherein the shutter moves between a closed position that covers the coin inlet and an open position that opens the coin inlet in accordance with a position of the second coin guide.

3. The coin recognition machine according to claim 2, wherein the shutter moves from the open position to the closed position when the second coin guide moves from the narrow position to the wide position.

4. The coin recognition machine according to claim 1, wherein the passage width adjustor adjusts a passage width of at least a portion of the coin passage to a first passage width when the second coin guide is located at the narrow position and adjusts a passage width of at least a portion of the coin passage to a second passage width, which is larger than the first passage width, when the second coin guide is located at the wide position.

5. The coin recognition machine according to claim 4, wherein the passage width adjustor maintains the first passage width of the coin passage until a predetermined period elapses from when the second coin guide starts to move from the narrow position to the wide position.

6. A coin recognition machine comprising:

a coin aligner including a first coin guide and a second coin guide, wherein the second coin guide moves between a narrow position that is close to the first coin guide and a wide position that is separated from the first coin guide, and the coin aligner is configured such that a specified number of coins fall from between the first coin guide and the second coin guide;

a coin inlet that receives a coin falling from between the first coin guide and the second coin guide, wherein the coin inlet is located below the first coin guide and the second coin guide, wherein when a coin is jammed between the first coin guide and the second coin guide, the coin aligner moves the second coin guide from the narrow positon to the wide position to widen a gap between the first coin guide and the second coin guide so that the jammed coin falls;

a shutter that covers the coin inlet when the second coin guide is located at the wide position; and an auxiliary coin guide that switches a guiding direction of a received coin in accordance with a position of the second coin guide.

7. The coin recognition machine according to claim 6, wherein the first coin guide and the second coin guide are located at an opposite side of the auxiliary coin guide from the shutter.

8. The coin recognition machine according to claim 7, further comprising a coin passage, wherein the first coin guide and the second coin guide are located at an opposite side of the coin passage from the coin inlet, wherein the auxiliary coin guide is located at a first guiding position that guides a coin to the coin inlet along the coin passage when the second coin guide is located at the narrow position, and the auxiliary coin guide is located at a second guiding position that guides a coin from the coin passage to outside the coin recognition machine when the second coin guide is located at the wide position.

9. A farebox comprising a coin recognition machine comprising:

a coin aligner including a first coin guide and a second coin guide, wherein the second coin guide moves between a narrow position that is close to the first coin guide and a wide position that is separated from the first coin guide, and the coin aligner is configured such that a specified number of coins fall from between the first coin guide and the second coin guide;

a coin inlet that receives a coin falling from between the first coin guide and the second coin guide, wherein the coin inlet is located below the first coin guide and the second coin guide, wherein when a coin is jammed between the first coin guide and the second coin guide, the coin aligner moves the second coin guide from the narrow positon to the wide position to widen a gap between the first coin guide and the second coin guide so that the jammed coin falls;

a shutter that covers the coin inlet when the second coin guide is located at the wide position;

a coin passage, wherein the first coin guide and the second coin guide are located at an opposite side of the coin passage from the coin inlet; and a passage width adjustor that adjusts a passage width of at least a portion of the coin passage in accordance with a position of the second coin guide.

* * * * *